US009303299B2

(12) United States Patent
Oda et al.

(10) Patent No.: US 9,303,299 B2
(45) Date of Patent: Apr. 5, 2016

(54) METHOD OF PRODUCTION OF ALUMINUM ALLOY WITH REFINED AL—FE—SI-BASED COMPOUNDS AND PRIMARY CRYSTAL SI

(71) Applicant: NIPPON LIGHT METAL COMPANY, LTD, Tokyo (JP)

(72) Inventors: Kazuhiro Oda, Shizuoka (JP); Tomohiro Isobe, Shizuoka (JP); Hiroshi Okada, Shizuoka (JP)

(73) Assignee: NIPPON LIGHT METAL COMPANY, LTD., Tokyo (JP)

( * ) Notice: Subject to any disclaimer, the term of this patent is extended or adjusted under 35 U.S.C. 154(b) by 151 days.

(21) Appl. No.: 14/350,087

(22) PCT Filed: Oct. 3, 2012

(86) PCT No.: PCT/JP2012/075692

§ 371 (c)(1),
(2) Date: Apr. 7, 2014

(87) PCT Pub. No.: WO2013/054716

PCT Pub. Date: Apr. 18, 2013

(65) Prior Publication Data

US 2014/0283651 A1 Sep. 25, 2014

(30) Foreign Application Priority Data

Oct. 11, 2011 (JP) ..... 2011-223694

(51) Int. Cl.
*C22C 1/02* (2006.01)
*C22C 21/02* (2006.01)
(Continued)

(52) U.S. Cl.
CPC ..... *C22C 1/026* (2013.01); *B22D 21/007* (2013.01); *B22D 27/20* (2013.01); *C22C 1/03* (2013.01);
(Continued)

(58) Field of Classification Search
CPC ..... C22C 1/026; C22C 21/02; C22C 21/04; C22C 1/036; C22C 1/03
See application file for complete search history.

(56) References Cited

U.S. PATENT DOCUMENTS 5,178,686 A 1/1993 Schmid et al.
6,200,396 B1 3/2001 Laslaz et al.
2007/0144629 A1* 6/2007 Okamoto ..... B21J 5/00 148/551

FOREIGN PATENT DOCUMENTS

JP 57-177943 A 11/1982
JP 62-227057 A 10/1987
(Continued)

OTHER PUBLICATIONS

Kalashnikov et al. SU 1726546 AI published Apr. 1992. Machine translation.*
(Continued)

*Primary Examiner* — George Wyszomierski
*Assistant Examiner* — Tima M McGuthry Banks
(74) *Attorney, Agent, or Firm* — Millen, White, Zelano, Branigan, P.C.

(57) ABSTRACT

A method of production of inexpensive aluminum alloy is provided which enables precipitation of fine particles of Al—Fe—Si-based compounds and primary crystal Si to an aluminum alloy melt which is comprised of Si: 10 to 20 mass %, Fe: 0.5 to 4 mass %, P: 0.003 to 0.02 mass %, and further, if necessary, one or more of Mn, Ni, and Cr or furthermore, if necessary, one or more of Mg, Ti, Cr, Zr, and V, and has a balance of Al and unavoidable impurities. To the melt is added 0.01 to 1 mass %, in terms of silicide, of a substance, which includes fine particles of a metal silicide which are present as a solid phase in the melt, when the Al—Fe—Si-based compound is crystallized.

14 Claims, 4 Drawing Sheets

Example 1:$CrSi_2$ added, no ultrasonic waves

Example 2:$TiSi_2$ added, no ultrasonic waves

Example 5:$TiSi_2$ added, no ultrasonic waves

Example 6:$CrSi_2$ added, no ultrasonic waves

Example 3:$MoSi_2$ added, no ultrasonic waves

Example 4:$CrSi_2$ added, no ultrasonic waves

Example 9:Al-Cr-Si alloy added, no ultrasonic waves

(51) Int. Cl.

| | |
|---|---|
| ***C22C 21/04*** | (2006.01) |
| ***C22C 1/03*** | (2006.01) |
| ***B22D 27/20*** | (2006.01) |
| ***C22F 1/00*** | (2006.01) |
| ***C22F 1/043*** | (2006.01) |
| ***C22C 32/00*** | (2006.01) |
| ***B22D 21/00*** | (2006.01) |

(52) U.S. Cl.

CPC ..... *C22C 21/02* (2013.01); *C22C 21/04* (2013.01); *C22C 32/0078* (2013.01); *C22F 1/00* (2013.01); *C22F 1/043* (2013.01)

(56) References Cited

FOREIGN PATENT DOCUMENTS

| | | | | |
|---|---|---|---|---|
| JP | 01-096341 | A | | 4/1989 |
| JP | 02-221349 | A | | 9/1990 |
| JP | 2002096157 | A | | 4/2002 |
| JP | 2002535488 | A | | 10/2002 |
| JP | 2004027316 | A | | 1/2004 |
| JP | 2004209487 | A | | 7/2004 |
| JP | 2010090429 | A | | 4/2010 |
| JP | 2011255392 | A | * | 12/2011 |
| SU | 1726546 | A1 | * | 4/1992 |
| WO | WO 8910982 | A1 | * | 11/1989 ..... C22C 1/02 |

OTHER PUBLICATIONS

Oda, K. JP 2011255392 A published Dec. 2011. Machine translation of the description.*

International Search Report from PCT/JP2012/075692 dated Nov. 13, 2012.

Supplementary European Search Report received in the related European Patent Application No. EP12840375 dated May 7, 2015.

Asensio-Lozano, J. et al. "Effect of the addition of refiners and/or modifiers on the microstructure of die cast A1-12Si alloys" Scripta Materialia, Elsevier, [2006], vol. 54, No. 5, pp. 943-947.

Prasada, Rao et al. "Microstructural features of as-cast A356 alloy inoculated with Sr, Sb modifiers and A1-Ti-C grain refiner simultaneously" Materials Letters [2007], vol. 62, No. 2, pp. 273-275.

* cited by examiner

Example 1:$CrSi_2$ added,
no ultrasonic waves

Example 2:$TiSi_2$ added,
no ultrasonic waves

Example 3:$MoSi_2$ added,
no ultrasonic waves

Example 4:$CrSi_2$ added,
no ultrasonic waves

Example 5:$TiSi_2$ added,
no ultrasonic waves

Example 6:$CrSi_2$ added,
no ultrasonic waves

Example 9:Al-Cr-Si alloy added,
no ultrasonic waves

Comp. Ex. 1:No ultrasonic waves

Comp. Ex. 2:Refining by ultrasonic waves

Comp. Ex. 3:No ultrasonic waves

Comp. Ex. 4:Refining by ultrasonic waves

Comp. Ex. 5:No ultrasonic waves

Comp. Ex. 6:No ultrasonic waves

METHOD OF PRODUCTION OF ALUMINUM ALLOY WITH REFINED AL—FE—SI-BASED COMPOUNDS AND PRIMARY CRYSTAL SI

TECHNICAL FIELD

The present invention relates to a method of production of aluminum alloy, more particularly relates to a method of production of aluminum alloy which enables Al—Fe—Si-based compounds and primary crystal Si to finely precipitate.

BACKGROUND ART

As aluminum alloy which is excellent in wear resistance, aluminum alloy which contains a large amount of Si is being widely used. Furthermore, it is also known to include Fe so as to improve the rigidity of aluminum alloy which contains a large amount of Si.

However, when producing aluminum alloy which contains a large amount of Si and Fe, the primary crystal Si and Al—Fe—Si-based compounds which precipitate in the process of cooling and solidification of the melt end up coarsening. Due to this, there was the problem that the strength, elongation, fatigue, and other mechanical properties fell and the workability ended up falling. In particular, Al—Fe—Si-based compounds are high in hardness and precipitate in needle shapes, so become obstacles in extrusion, rolling, and other secondary working.

To prevent coarsening of the primary crystal Si or Al—Fe—Si-based compounds when producing an aluminum alloy which contains a large amount of Si and Fe, various proposals have been made.

For example, PLT 1 proposes the method of adjusting the quantitative relationships of "Fe and Ni" and "Fe and Mn" to prevent coarse precipitates from forming and enabling precipitates to uniformly and finely disperse. Specifically, if adjusting the amounts of Ni, Fe, and Mn contained to $Fe \leq -0.25Ni+1.75$ and further $Mn \leq 0.6Fe$ in relationships, precipitation of easily coarsening $Al_3(Ni,Mn,Fe)$ is suppressed.

Further, PLT 2 adjusts the Si content to 1.7×Fe content+13 to 13.7 mass %, the Ti content to 0.05 to 0.07×Fe content+0.1 mass %, the Cr content to 0.1×Fe content+0.05 to 0.15 mass %, and the Mn content to 0.4 to 0.6×Fe content and treats the melt at the liquidus temperature or more by ultrasonic waves.

By treating the aluminum alloy melt at the liquidus temperature or more by ultrasonic vibration, the number of embryos of crystal nuclei of precipitates which form from the aluminum melt are increased to form a large number of fine crystal nuclei and cause precipitation of fine crystals. Further, by adjusting the ingredients and ranges of composition of the aluminum alloy melt as explained above, various types of precipitates are formed in a short time. Further, Al—Ti-based precipitates, Al—Cr-based precipitates, Al—Fe-based precipitates, and solitary Si are made to precipitate in that order and the Al—Fe-based precipitates are formed using the Al—Ti-based precipitates and Al—Cr-based precipitates as nuclei.

CITATIONS LIST

Patent Literature

PLT 1. Japanese Patent Publication No. 2004-027316A

PLT 2. Japanese Patent Publication No. 2010-090429A

SUMMARY OF INVENTION

Technical Problems

However, with the method of PLT 1, the precipitates are increased by increasing the amounts of addition of Si, Fe, Mn, Ni, etc., but when the amount of addition of Fe is great, just adjusting the amounts of Mn and Ni is not sufficient to obtain fine particles of a Al—Fe—Si-based compound.

Further, with the method of PLT 2, the Cr-based and Ti-based compounds are first refined and these particles are used as heterogeneous nuclei to refine the Al—Fe—Si-based compound. However, the melt is treated by ultrasonic waves, so not only does the cost rise along with the addition of the ultrasonic treatment equipment, but also there is the problem that the horn size limits the treatment amount.

The present invention was made to solve such a problem and has as its object the provision of a method of production of inexpensive aluminum alloy which enables fine precipitation of Al—Fe—Si-based compounds and primary crystal Si by employing simple means.

Solution to Problem

The method of production of aluminum alloy with refined Al—Fe—Si-based compounds and primary crystal Si of the present invention, to achieve this object, is characterized by adding to an aluminum alloy melt which contains Si: 10 to 20 mass %, Fe: 0.5 to 4 mass %, and P: 0.003 to 0.02 mass % and has a balance of Al and unavoidable impurities, a substance which contains fine particles of a metal silicide which are present as a solid phase in the melt at the time of precipitation of an Al—Fe—Si-based compound, in 0.01 to 1 mass % as a silicide.

The aluminum alloy melt may be one which includes one or more of any of Mn, Ni, Cu, and Cr and further may be one which includes one or more of any of Mg, Ti, Cr, Zr, and V.

As the substance which contains fine particles of a metal silicide which is added to the aluminum alloy melt, a powder of the metal silicide itself or a base alloy is preferable.

Advantageous Effects of Invention

According to the method of production of aluminum alloy of the present invention, by adding to an aluminum alloy melt which contains Si and Fe, fine particles of a metal silicide which are present as a solid phase in the melt at the time of precipitation of an Al—Fe—Si-based compound and which act as solidification nuclei for the Al—Fe—Si-based precipitate, an effect of refinement equal to treatment by ultrasonic waves is obtained.

Further, ultrasonic treatment equipment such as at the time of treatment by ultrasonic waves is not necessary, so the cycle time can be shortened. There are also few restrictions on the amount of treatment due to the horn size and aluminum alloy which is free from contamination from the horn can be obtained. Further, unlike with treatment by ultrasonic waves, reliably formed heterogeneous nuclei are added. In this respect, the reliability is higher than the case of treatment by ultrasonic waves.

DESCRIPTION OF EMBODIMENTS

Figure 1A:
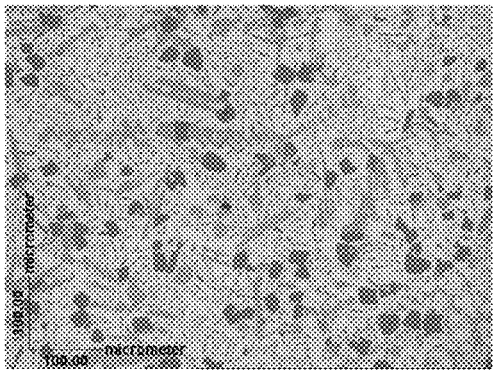
FIG. 1A is a view which shows structures which were refined according to Examples 1 to 4 of the present invention.
Figure 1A:
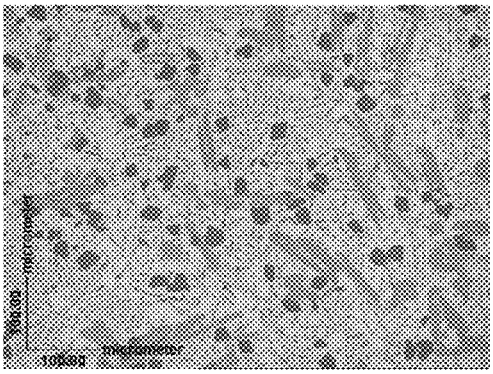
Figure 1A:
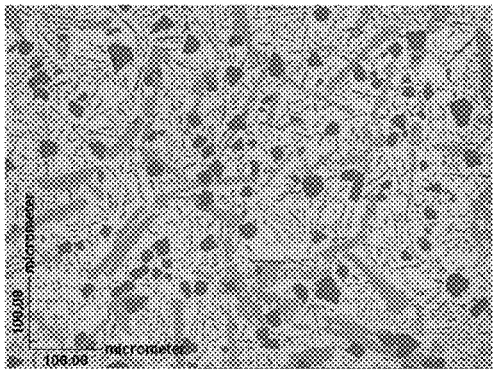
Figure 1A:
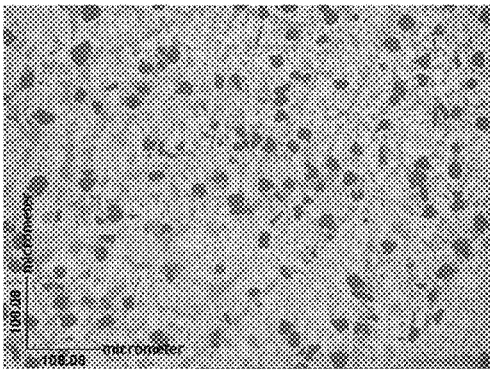

The inventors etc. engaged in intensive studies on a method of preventing coarsening of precipitates which form in the process of cooling and solidification of a melt when producing aluminum alloy which contains a large amount of Si and Fe, in particular Al—Fe—Si-based precipitates, and causes precipitation of fine particles.

In the method which is proposed in PLT 2, the effect of refining the Al—Fe—Si-based precipitates and primary crystal Si is obtained. When investigating the heterogeneous nuclei in the Al—Fe—Si which was refined by treatment by ultrasonic waves, it was learned that a Cr-based compound of $CrSi_2$ and a Ti-based compound of $TiSi_2$ formed heterogeneous nuclei.

Note that, in this Description, when mentioning "primary Si", even when Al—Fe—Si or other compounds precipitate as primary crystals, they are described as "primary crystal Si" to differentiate them from eutectic Si.

Therefore, if including in an aluminum alloy melt which contains a large amount of Si and Fe, fine particles of a metal silicide which are present as a solid phase in the melt at the time of precipitation of an Al—Fe—Si-based compound, these functioned as the heterogeneous nuclei for Al—Fe—Si-based precipitates and primary crystal Si, an effect of refinement of the precipitate was probably obtained, and therefore the present invention was reached.

Note that, as "the fine particles of a metal silicide which are present as a solid phase in the melt at the time of precipitation of an Al—Fe—Si-based compound", in the sense of a silicide with a higher melting point that the Al—Fe—Si-based compound, $CrSi_2$, $TiSi_2$, $WSi_2$, $MoSi_2$, $ZrSi_2$, $TaSi_2$, $NbSi_2$, may be envisioned. The above metal silicides have melting points of 1500 to 2000° C. Even if the melting point is 1500 to 2000° C., if held in the melt, they will eventually end up melting, but if a high melting point, they can remain present as a solid phase for a while and can serve as solidification nuclei. Conversely, if ending up melting all at once, they will not necessarily precipitate as metal silicides, so the nuclei will end up being eliminated. For example, in an Al—Si—Fe-based alloy, if $CrSi_2$ melts, the Cr will not precipitate as $CrSi_2$, but will precipitate in the form of Al—(Fe, Cr)—Si with part of the Fe in the Al—Fe—Si-based compound substituted.

Below, the present invention will be described in detail. First, the ingredients and ranges of composition of the aluminum alloy melt before treatment will be explained.

Si: 10 to 20 Mass %

Si is an essential element for improving the aluminum alloy in rigidity and wear resistance and reducing the thermal expansion and is included in 10 to 20 mass % in range. If the Si content does not satisfy 10 mass %, sufficient rigidity, wear resistance, and low thermal expansion cannot be obtained, while the more over 20 mass %, the more remarkably higher the liquidus and the harder the melting and casting.

Fe: 0.5 to 4 Mass %

This precipitates as the Al—Fe—Si-based compound and improves the aluminum alloy in rigidity and lowers the thermal expansion. If the Fe content is less than 0.5 mass %, the amount of Al—Fe—Si-based precipitate which is required for raising the rigidity cannot be obtained, while if over 4 mass %, the precipitated particles end up becoming coarser, so the workability falls. Furthermore, if over 4 mass %, addition of $TiSi_2$ etc. to serve as the heterogeneous nuclei becomes necessary. At this time, the liquidus becomes higher and the casting temperature has to be raised. Due to this, the amount of gas in the melt increases and casting defects are formed. Further, the rise in the casting temperature also invites a drop in the refractory material lifetime.

Mn: 0.6×Fe Mass % or Less

Mn has the action of changing the needle-shaped coarse Al—Fe—Si-based precipitates into masses when cooling and solidifying an aluminum alloy melt which contains Fe, so is included as needed. However, if greater than 0.6×Fe, coarse compounds end up being formed together with the Fe. When the addition of Mn is small in amount, addition of $WSi_2$ or $MoSi_2$ is particularly effective. This is because when the amount of addition of Mn is small, the precipitated Al—Fe—Si-based $\tau_4$ phase and the $WSi_2$ and $MoSi_2$ become the same crystal systems (hexagonal crystals). With other crystal systems, the effect of refinement falls somewhat. On the other hand, when Mn is sufficiently added, an Al—Fe—Si-based $\tau_5$ phase (hexagonal crystal) precipitates. The $\tau_5$ phase easily is refined if there are heterogeneous nuclei present. The phase is refined by the orthorhombic crystal of $TiSi_2$ or $ZrSi_2$, hexagonal crystal of $CrSi_2$, $TaSi_2$, or $NbSi_2$, or rhombic crystal of $WSi_2$ or $MoSi_2$.

Cu: 0.5 to 8 Mass %

Cu acts to raise the mechanical strength, so is added as needed. Further, as an Al—Ni—Cu-based compound, it also raises the rigidity and lowers the thermal expansion. Further, it also raises the high temperature strength. This action becomes remarkable with addition of 0.5 mass % or more, but if over 8 mass %, the compound becomes coarser, the mechanical strength falls, and the corrosion resistance also ends up falling. Therefore, the amount of addition of Cu is preferably 0.5 to 8%.

Ni: 0.5 to 6 mass %

Ni precipitates as an Al—Ni—Cu-based compound in the state where Cu is present and acts to raise the rigidity and reduce the thermal expansion, so is added as needed. Further, the high temperature strength is also improved. This action is particularly effective at 0.5 mass % or more. If over 6.0 mass %, the liquidus temperature becomes higher, so the castability deteriorates. Therefore, the amount of addition of Ni is preferably made 0.5 to 6.0 mass % in range.

Mg: 0.05 to 1.5 Mass %

Mg is an alloy element which is useful for making the aluminum alloy rise in strength, so is added according to need. By making the Mg 0.05 mass % or more, the above effect can be achieved, but if over 1.5 mass %, the matrix becomes hard and the toughness falls, so this is not preferred. Therefore, the amount of addition of Mg is preferably made 0.05% to 1.5 mass %.

Ti: 0.01 to 1.0 Mass %, Cr: 0.01 to 1.0 Mass %

Ti has the action of refining crystal grains and contributes to the improvement of the high temperature strength. Further, Ti and Cr are peritectic-based added elements. They are small in coefficient of dispersion in Al, form solid solutions which are stable at a high temperature, and contribute to improvement of the high temperature strength. Further, Cr, like Mn, has the action of changing needle-shaped coarse Al—Fe—Si-based precipitates to masses. Therefore, the above elements can be added in the required amounts in accordance with the desired properties. If the amounts of Ti and Cr are less than 0.01 mass %, the above such effects are hard to obtain, while the more the amounts exceed 1.0 mass %, the coarser the compounds which are formed and the more the mechanical strength falls. Further, the liquidus becomes higher and the casting temperature has to be raised. Due to this, the amount of gas in the melt increases and casting defects occur. Further, a fall in the refractory material lifetime is invited. Therefore, the amounts of addition of Ti and Cr are preferably made 0.01 to 1.0 mass %.

Zr: 0.01 to 1.0 mass %, V: 0.01 to 1.0 mass %

Zr and V have the action of refining the crystal grains and improving the strength and elongation. Even added alone, they are effective, so are added as needed. Further, both Zr and V work to suppress oxidation of the melt, while V has the effect of raising the high temperature strength. If Zr is less than 0.01 mass % and V is less than 0.01% mass %, a sufficient effect cannot be obtained. Conversely, if Zr is greater than 1.0 mass % and V is greater than 1.0 mass %, coarse intermetallic compounds precipitate and the strength and elongation fall. Further, the liquidus becomes higher and the casting temperature has to be raised.

P: 0.003 to 0.02 Mass %

P acts as a refining agent of primary crystal Si. To make this action be effectively expressed, inclusion in 0.003 mass % is necessary. However, if including P in an amount over 0.02 mass %, the melt flowability becomes poorer and melt misrun and other casting defects easily occur. Therefore, the upper limit of the P content is made 0.02 mass %.

Next, the form, amount of addition, etc. of the substance which is added to the aluminum alloy melt and acts as solidification nuclei at the time of precipitation of the Al—Fe—Si-based compound and primary crystal Si will be explained.

To the aluminum alloy melt which was adjusted in ranges of composition of elements as explained above, fine particles of one or more types of metal silicides which are present as a solid phase in the melt at the time of precipitation of the Al—Fe—Si-based compound are added in 0.01 to 1.0 mass % as silicide.

The fine particles of the metal silicide which are present as a solid phase in the melt at the time of precipitation of the Al—Fe—Si-based compound become heterogeneous nuclei for the Al—Fe—Si-based compound and can make the Al—Fe—Si-based compound precipitate as fine particles. If 0.01 mass % or less, this effect cannot be obtained, while the more over 1.0 mass %, the higher the melt in viscosity and the poorer the flowability.

As specific names of the metal silicides, the above $CrSi_2$, $TiSi_2$, $WSi_2$, $MoSi_2$, $ZrSi_2$, $TaSi_2$, $NbSi_2$, etc. may be mentioned. Further, these metal silicides may be combined for addition as well.

When adding the metal silicide as a powder, the powder itself acts as heterogeneous nuclei, so this is effective. These metal silicides need only retain their refined forms when added to the aluminum alloy melt. For example, in the case of $CrSi_2$, it may be added in the form of Al-15 mass % Si-4 mass % Cr alloy which has been rapidly cooled and solidified to cause $CrSi_2$ to finely precipitate, a cast material of Al-15 mass % Si-4 mass % Cr alloy which is plastically worked, then finely crushed, or other form of the base alloy not limited to the powder of the metal silicide itself.

When added as a base alloy, with the usual casting method, the $CrSi_2$ etc. coarsen and sometimes become coarser than the Al—Fe—Si-based compound, but unless sufficiently smaller than the Al—Fe—Si-based compound, they will not act as heterogeneous nuclei, so the particles are made finer by rapid cooling or the coarsened particles are processed to make them finer or other such methods are used. Further, when added as a base alloy, the dispersability tends to be improved and the yield tends to become better than when adding a powder of the metal silicide itself. Note that, if $CrSi_2$ etc. can be made finer, another method of production is also possible.

Note that, as the timing for addition of the fine particles of metal silicide into the aluminum alloy melt, any time after adjusting the alloy composition of the melt and up to casting is possible. However, to make the fine particles of the metal silicide effectively act as solidification nuclei, it is preferable to sufficiently secure time after addition so that the metal silicide spreads throughout the melt.

Further, according to the findings of the inventors, even if held at 770° C., which is higher than the general casting holding temperature, for several hours, a refining effect is obtained, but if holding the melt at a high temperature of 1000° C. or more for a long period of time, the metal silicide is liable to melt.

The subsequent casting method, cooling conditions, etc. are not particularly limited.

EXAMPLES

Al-25 mass % Si alloy, Al-5 mass % Fe alloy, Al-10 mass % Mn alloy, Al-5 mass % Cr alloy, Al-10 mass % Ti alloy, Al-19 mass % Cu-1.4 mass % P alloy, Al-20 mass % Ni alloy, Al-30 mass % Cu alloy, Al-5 mass % Zr alloy, Al-5 mass % V alloy, pure Si, pure Fe, pure Cu, and pure Mg were used to prepare the aluminum alloy melts of the compositions of ingredients which are described in Table 1. Note that Comparative Example 6 is a commercially available JIS-ADC12 alloy.

To melts of these aluminum alloys at the temperatures which are shown in Table 2, powders made by Japan New Metals of an average particle size of 2 to 5 μm such as $CrSi_2$ powder (Product No. $CrSi_2$-F), $TiSi_2$ powder (Product No. $TiSi_2$-F), and $MoSi_2$ powder (Product No. $MoSi_2$-F) were added in the amounts which are shown in Table 2. Note that, in Comparative Examples 2 and 4, the melts were treated with ultrasonic waves at 760° C. for 30 seconds. The composition of the Al—Cr—Si alloy was Al-3.5 mass % Cr-15.0 mass % Si and was prepared using Al-25 mass % Si alloy, Al-5 mass % Cr alloy, and pure Si. This was melted at 1050° C. and cast. The casting mold was made a JIS No. 4 boat mold (30×50×200) and the mold temperature was made 100° C. In the Al—Cr—Si alloy casting, $CrSi_2$ precipitated. This, in the same way as $CrSi_2$ powder, was made to act as solidification nuclei for the Al—Si—Fe-based compound. The prepared casting was cut into small pieces and used as a refining agent.

After that, each melt was cast under the conditions shown in the same Table 2. The casting mold had a size of a diameter of 13 mm and length of 100 mm forming a circular rod. The melt was cast at a mold temperature of 140° C. After casting, the melt was cooled by 100° C./sec. The cooled casting was examined for structure and investigated for state of distribution of precipitates without heat treatment. The results are shown together in Table 2.

Figure 1B:
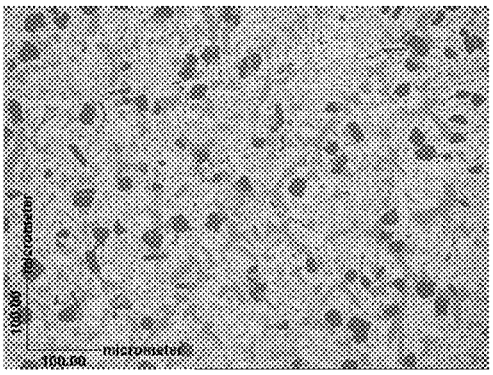
FIG. 1B is a view which shows structures which were refined according to Examples 5 to 6 and 9 of the present invention.
Figure 1B:
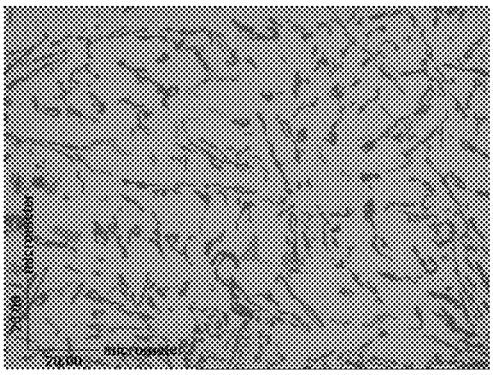
Figure 1B:
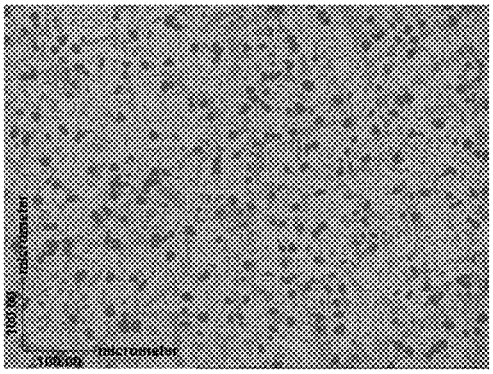
Figure 2A:
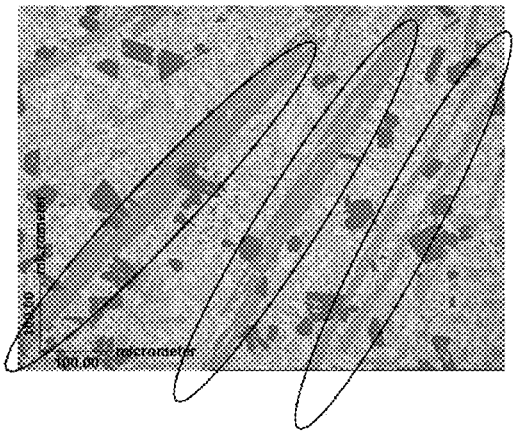
FIG. 2A is a view which shows the difference in refined structures due to the presence or absence of treatment by ultrasonic waves in Comparative Examples 1 to 4.
Figure 2A:
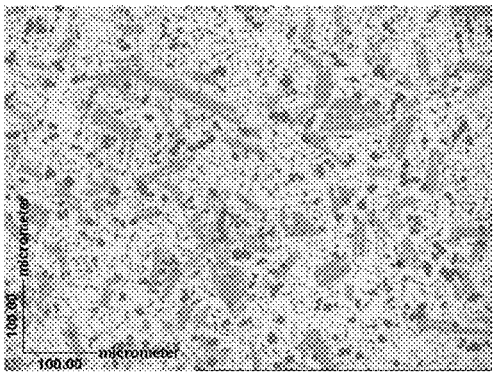
Figure 2A:
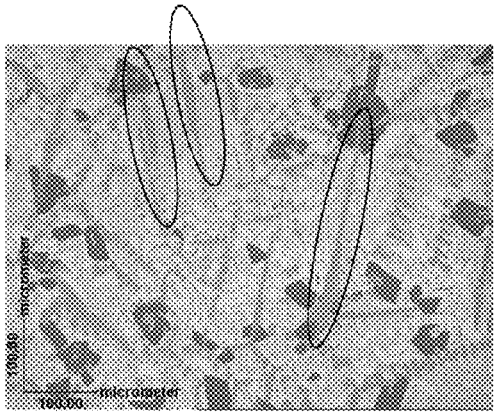
Figure 2A:
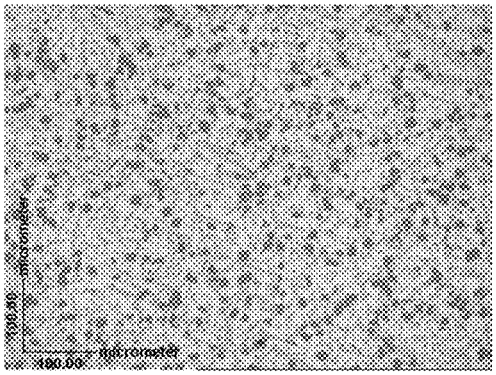
Figure 2B:
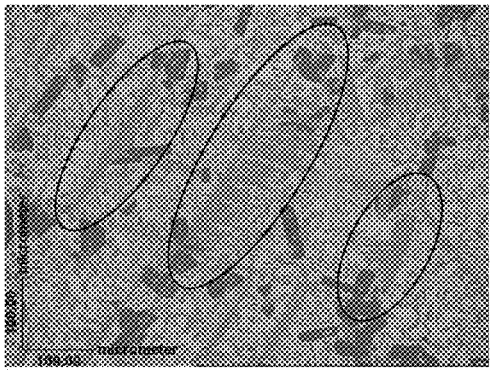
FIG. 2B is a view which shows structures which were not refined due to the omission of treatment by ultrasonic waves in Comparative Examples 5 to 6.
Figure 2B:
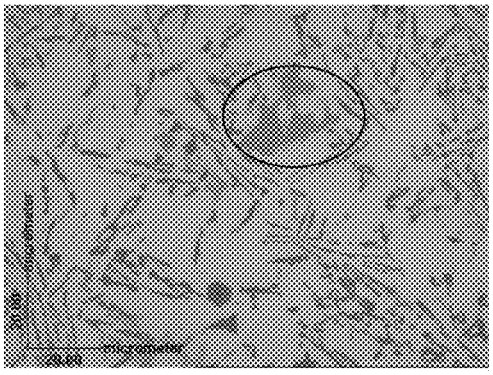

Further, structural photographs of the samples are shown in FIGS. 1A, 1B, 2A, and 2B. Examples 1, 2, and 3 and Comparative Examples 1 and 2 use alloys which have equivalent compositions of ingredients as samples and examine the effects of addition of metal silicides. Even if not performing ultrasonic wave treatment, Examples 1, 2, and 3 give Al—Fe—Si-based compounds which are finer than Comparative Example 1 and give structures which are equivalent to Comparative Example 2 which performed ultrasonic wave treatment.

Further, Examples 4 and 5 and Comparative Examples 3, 4, and 5 use alloys which have equivalent compositions of ingredients as samples and examine the effects of addition of metal silicides. Even if not performing ultrasonic wave treatment, Examples 4 and 5 give Al—Fe—Si-based compounds which are finer than Comparative Examples 3 and 5 and give structures which are equivalent to Comparative Example 4 which performed ultrasonic wave treatment.

Further, Example 6 and Comparative Example 6 use alloys which have equivalent compositions of ingredients as samples. Example 6 gives an Al—Fe—Si-based compound which is finer than Comparative Example 6 which does not perform ultrasonic wave treatment.

Example 9 uses an alloy which has a composition of ingredients equivalent to that of Example 4 as a sample. Example 4 adds $CrSi_2$ powder, while Example 9 adds Al—Cr—Si alloy and obtains an equivalently fine Al—Fe—Si-based compound. Further, Example 9 performs ultrasonic wave treatment, but the structure is a fine one of the same extent as Comparative Example 4 where ultrasonic wave treatment was performed. Further, Example 9 used an alloy which has a composition of ingredients equivalent to that of Comparative Example 5 as a sample. Comparative Examples 5 does not perform ultrasonic wave treatment and does not add an Al—Cr—Si alloy, so the Al—Fe—Si-based compound is coarse. As opposed to this, in Example 9, due to the effect of addition of the Al—Cr—Si alloy, the Al—Fe—Si-based compound is refined.

From the above results, it will be understood that by adding fine particles of a metal silicide to an aluminum alloy melt, a refined structure is obtained.

TABLE 1

Composition of Ingredients of Tested Aluminum Alloy Materials (mass %)

| | Si | Fe | Mn | Cr | Ti | P | Ni | Cu | Mg | Zr | V |
|---|---|---|---|---|---|---|---|---|---|---|---|
| Ex. 1 | 18.6 | 3.7 | 2.0 | <0.01 | <0.01 | 0.006 | — | — | — | — | — |
| Ex. 2 | 18.6 | 3.7 | 2.0 | <0.01 | <0.01 | 0.006 | — | — | — | — | — |
| Ex. 3 | 18.6 | 3.7 | 2.0 | <0.01 | <0.01 | 0.006 | — | — | — | — | — |
| Ex. 4 | 18.6 | 3.8 | 2.0 | 0.25 | <0.01 | 0.006 | — | — | — | — | — |
| Ex. 5 | 18.6 | 3.8 | 2.0 | 0.25 | <0.01 | 0.006 | — | — | — | — | — |
| Ex. 6 | 10.7 | 0.7 | 0.2 | 0.05 | 0.04 | 0.002 | — | — | — | — | — |
| Ex. 7 | 18.5 | 4 | 2 | 0.3 | <0.01 | 0.01 | 5.0 | 5.0 | — | — | — |
| Ex. 8 | 18.5 | 4 | 2 | 0.3 | 0.5 | 0.01 | 5.0 | 5.0 | 0.5 | 0.5 | 0.5 |
| Ex. 9 | 18.5 | 3.6 | 2.0 | 0.3 | <0.01 | 0.009 | — | 0.5 | — | — | — |
| Comp. Ex. 1 | 18.7 | 4.1 | 2.1 | <0.01 | <0.01 | 0.007 | — | — | — | — | — |
| Comp. Ex. 2 | 18.7 | 4.1 | 2.1 | <0.01 | <0.01 | 0.007 | — | — | — | — | — |
| Comp. Ex. 3 | 18.3 | 3.7 | 2.0 | 0.43 | 0.47 | 0.008 | — | — | — | — | — |
| Comp. Ex. 4 | 18.3 | 3.7 | 2.0 | 0.43 | 0.47 | 0.008 | — | — | — | — | — |
| Comp. Ex. 5 | 18.6 | 3.8 | 2.0 | 0.25 | <0.01 | 0.008 | — | — | — | — | — |
| Comp. Ex. 6 | 10.7 | 0.7 | 0.2 | 0.05 | 0.04 | 0.006 | — | — | — | — | — |

TABLE 2

Treatment Conditions and Refining Effect

| | Addition temp. (° C.) | Silicide: Type | Silicide: Amount of addition (%) | Silicide: Method of addition | Time after addition (treatment by ultrasonic waves) until casting (sec) | Casting temp. (° C.) | Structure |
|---|---|---|---|---|---|---|---|
| Ex. 1 | 780 | $CrSi_2$ | 0.02 | Powder addition | 1800 | 770 | Equal to Comp. Ex. 2 |
| Ex. 2 | 780 | $TiSi_2$ | 0.04 | Powder addition | 1800 | 770 | Equal to Comp. Ex. 2 |
| Ex. 3 | 780 | $MoSi_2$ | 0.03 | Powder addition | 1800 | 770 | Equal to Comp. Ex. 2 |
| Ex. 4 | 780 | $CrSi_2$ | 0.01 | Powder addition | 1800 | 770 | Equal to Comp. Ex. 4 |
| Ex. 5 | 780 | $TiSi_2$ | 0.02 | Powder addition | 1800 | 770 | Equal to Comp. Ex. 4 |
| Ex. 6 | 760 | $CrSi_2$ | 0.01 | Powder addition | 1800 | 730 | Fine structure |
| Ex. 7 | 780 | $CrSi_2$ | 0.02 | Powder addition | 1800 | 770 | Equal to Comp. Ex. 4 |
| Ex. 8 | 780 | $CrSi_2$ | 0.02 | Powder addition | 1800 | 770 | Equal to Comp. Ex. 4 |
| Ex. 9 | 780 | $CrSi_2$ | 0.08 | Al—Cr—Si alloy | 1800 | 770 | Equal to Comp. Ex. 4 |
| Comp. Ex. 1 | — | — | — | — | — | 770 | Coarse crystals present |
| Comp. Ex. 2 | — | — | — | — | 20 | 750 | Refined by ultrasonic waves |
| Comp. Ex. 3 | — | — | — | — | — | 770 | Coarse crystals present |
| Comp. Ex. 4 | — | — | — | — | 20 | 750 | Refined by ultrasonic waves |
| Comp. Ex. 5 | — | — | — | — | — | 770 | Coarse crystals present |
| Comp. Ex. 6 | — | — | — | — | — | 730 | Some coarsening |

INDUSTRIAL APPLICABILITY

According to the present invention, a method of production of inexpensive aluminum alloy which enables precipitation of fine particles of an Al—Fe—Si-based compound and primary crystal Si is provided by employing simple means.

The invention claimed is:

1. A method of production of aluminum alloy with refined Al—Fe—Si-based compounds and primary crystal Si, said method comprising:

adding to an aluminum alloy melt which contains Si: 10 to 20 mass %, Fe: 0.5 to 4 mass %, and P: 0.003 to 0.02 mass % and has a balance of Al and unavoidable impurities, a substance which contains particles of a metal silicide which are present as a solid phase in the melt during precipitation of an Al—Fe—Si-based compound, in 0.01 to 1 mass % as a silicide, wherein said particles function as heterogeneous nuclei for Al—Fe—Si-based precipitates and primary crystal Si.

2. The method according to claim 1, wherein said aluminum alloy melt further contains Ni: 0.5 to 6 mass %.

3. The method according to claim 2, wherein said aluminum alloy melt further contains Cu: 0.5 to 8 mass %.

4. The method according claim 1, wherein said aluminum alloy melt further contains one or more of any of Mg: 0.05 to 1.5 mass %, Ti: 0.01 to 1.0 mass %, Cr: 0.01 to 1.0 mass %, Zr: 0.01 to 1.0 mass %, and V: 0.01 to 1.0 mass %.

5. The method according to claim 1, wherein the substance which contains the particles of a metal silicide which are added to the aluminum alloy melt is a powder of the metal silicide itself or an aluminum-based alloy containing silicon and chromium.

6. The method according to claim 1, wherein said aluminum alloy melt further contains Cu: 0.5 to 8 mass %.

7. The method according to claim 1, wherein said metal silicide is selected from $CrSi_2$, $TiSi_2$, $WSi_2$, $MoSi_2$, $ZrSi_2$, $TaSi_2$, $NbSi_2$, and combination thereof.

8. A method of production of aluminum alloy with refined Al—Fe—Si-based compounds and primary crystal Si, said method comprising:

adding to an aluminum alloy melt which contains Si: 10 to 20 mass %, Fe: 0.5 to 4 mass %, Mn: 0.6×Fe mass % or less, and P: 0.003 to 0.02 mass % and has a balance of Al and unavoidable impurities, a substance which contains particles of a metal silicide which are present as a solid phase in the melt during precipitation of an Al—Fe—Si-based compound, in 0.01 to 1 mass % as a silicide, wherein said particles function as heterogeneous nuclei for Al—Fe—Si-based precipitates and primary crystal Si.

9. The method according to claim 8, wherein said aluminum alloy melt further contains Ni: 0.5 to 6 mass %.

10. The method according to claim 9, wherein said aluminum alloy melt further contains Cu: 0.5 to 8 mass %.

11. The method according to claim 8, wherein said aluminum alloy melt further contains Cu: 0.5 to 8 mass %.

12. The method of according claim 8, wherein said aluminum alloy melt further contains one or more of any of Mg: 0.05 to 1.5 mass %, Ti: 0.01 to 1.0 mass %, Cr: 0.01 to 1.0 mass %, Zr: 0.01 to 1.0 mass %, and V: 0.01 to 1.0 mass %.

13. The method according to claim 8, wherein the substance which contains the particles of a metal silicide which are added to the aluminum alloy melt is a powder of the metal silicide itself or an aluminum-based alloy containing silicon and chromium.

14. The method according to claim 8, wherein said metal silicide is selected from $CrSi_2$, $TiSi_2$, $WSi_2$, $MoSi_2$, $ZrSi_2$, $TaSi_2$, $NbSi_2$, and combination thereof.

* * * * *